United States Patent [19]

Sassa

[11] Patent Number: 4,653,184

[45] Date of Patent: Mar. 31, 1987

[54] APPARATUS FOR HOLDING BOXES IN ATTACHMENT OF SAME TO SEPARABLE SLIDE FASTENER CHAIN WITH BOX PIN AND INSERTION PIN

[75] Inventor: Yuusei Sassa, Namerikawa, Japan

[73] Assignee: Yoshida Kogyo K. K., Tokyo, Japan

[21] Appl. No.: 783,142

[22] Filed: Oct. 2, 1985

[30] Foreign Application Priority Data

Oct. 5, 1984 [JP] Japan ..... 59-150779[U]

[51] Int. Cl.[4] ..... A41H 37/06

[52] U.S. Cl. ..... 29/767; 29/33.2

[58] Field of Search ..... 29/33.2, 408–410, 29/766–770

[56] References Cited

U.S. PATENT DOCUMENTS

| | | | |
|---|---|---|---|
| 4,332,071 | 6/1982 | Takahashi | 29/767 |
| 4,437,233 | 3/1984 | Yosheuda et al. | 29/767 |
| 4,494,293 | 1/1985 | Kawakami | 29/408 |
| 4,510,658 | 4/1985 | Takahashi | 29/767 |
| 4,520,560 | 6/1985 | Nakagawa | 29/408 |

*Primary Examiner*—Howard N. Goldberg
*Assistant Examiner*—Steven Nichols

[57] ABSTRACT

A box holder vertically movably mounted on a frame is reciprocably movable between a box attaching position and a box receiving position. The box holder includes a recess for receiving a box and a clamp finger for retaining the box in the recess. The clamp finger is pivotably mounted on a slide block vertically movably disposed in a recessed portion defined in the box holder adjacent to the recess. The box holder further includes a cam facing the recessed portion and a cam follower provided on the clamp finger. Upon vertical movement of the slide block, the cam follower is brought into engagement with the cam to cause the clamp finger to angularly move toward and away from the recess, thereby releasably retaining the box in the recess. The box holder thus constructed is compact in structure and reliable in operation.

6 Claims, 11 Drawing Figures

APPARATUS FOR HOLDING BOXES IN ATTACHMENT OF SAME TO SEPARABLE SLIDE FASTENER CHAIN WITH BOX PIN AND INSERTION PIN

BACKGROUND OF THE INVENTION

1. Field of the Invention

The present invention relates generally to an apparatus for attaching a box to a box pin on an end of an elongate separable slide fastener chain in the manufacture of a separable slide fastener with a separable end stop. More particularly, it relates to an apparatus adapted to be employed in such box attachment apparatus for holding a box during attaching process of the latter to the separable slide fastener chain.

2. Prior Art

There are known apparatus for attaching a box to a box pin on an end of a slide fastener chain. One such known apparatus is shown in FIG. 10 of the accompanying drawings and includes a box holder A swingably mounted for angular movement between a box receiving position which is located adjacent to the discharge end of a box supply chute C adapted to feed boxes B one at a time to the box holder A, and a box attaching position which is located in a feed path of a separable slide fastener chain F having a pair of laterally aligned pins on an end thereof. As the separable slide fastener chain is fed along the feed path F, the pins are received in the box B while the latter is at rest in the box attaching position. Then, the box and one of the pins are joined together to form a separable box, the separable box and the other pin jointly constituting a separable end stop.

The known box attaching apparatus having such swingable box holder is complex in structure because the box holder includes a box-gripper mechanism, a gripper actuating mechanism, and a holder rocking mechanism. Furthermore, the swingable box holder occupies a relatively large space for its operation and requires a tedious handling. With these difficulties, the known apparatus fails to meet a desire of providing a compact box attaching apparatus.

SUMMARY OF THE INVENTION

It is accordingly an object of the present invention to provide an apparatus for holding a box in the process of attaching the box to a box pin on a separable slide fastener chain, the apparatus being simple in construction, reliable in operation, and compact and hence occupying a relatively small space for its operation.

According to the present invention, an apparatus for holding a box chain in the attachment of the latter to a separable slide fastener, comprises a box holder vertically movably mounted on a frame and reciprocably movable between a box attaching position located in a feed path of the slide fastener chain and a box receiving position remote from the box attaching position. The box holder includes a recess for receiving the box and a clamp finger for retaining the box in the recess. The clamp finger is pivotably mounted on a slide block vertically movably disposed in a recessed portion defined in the box holder adjacent to the box receiving recess. The box holder further includes a cam facing the recessed portion and engageable with a cam follower portion of the clamp finger. Upon vertical movement of the slide block, the cam follower portion engages the cam to cause the clamp finger to angularly move toward and away from the recess, thereby releasably retaining the box in the recess.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
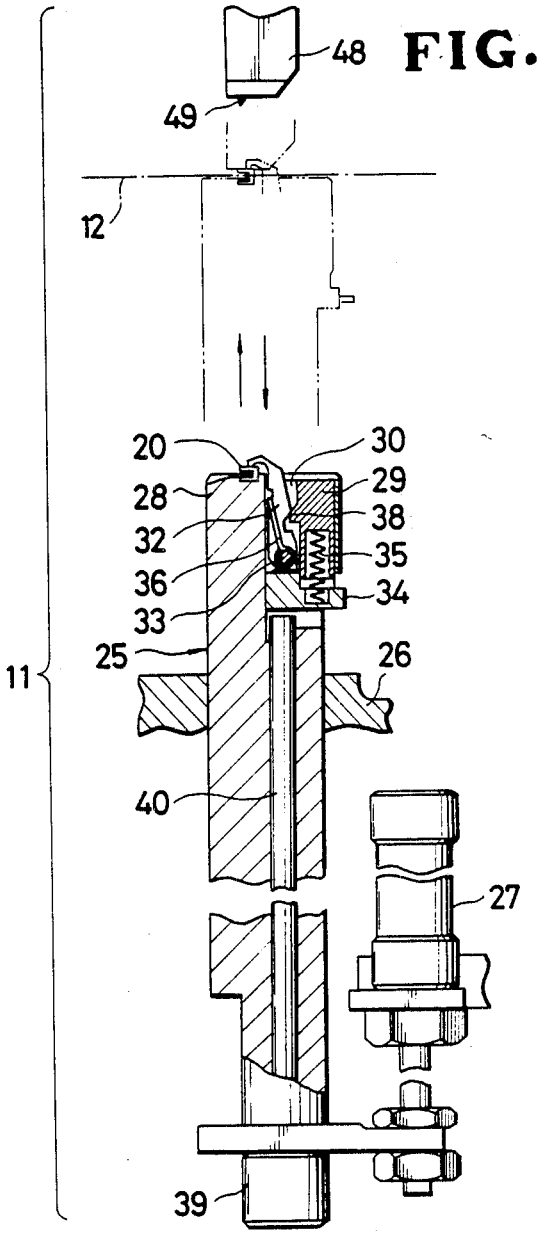
FIG. 1 is a vertical cross-sectional view, partly in elevation, of a box attachment apparatus including a box holding apparatus embodying the present invention.

The principles of the present invention are particularly useful when embodied in an apparatus such as shown in FIG. 1, generally indicated by the numeral 11.

Figure 7A:
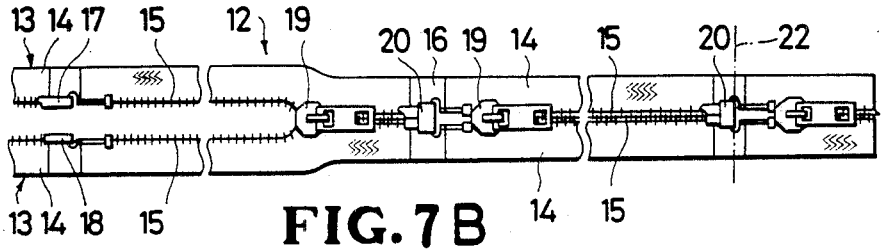
FIG. 7A is a fragmentary bottom view of an elongate separable slide fastener chain.
Figure 7B:
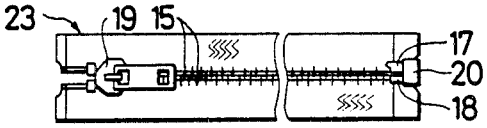
FIG. 7B is a bottom view of an individual slide fastener cut off from the elongate separable slide fastener chain illustrated in FIG. 7A.
Figure 8:
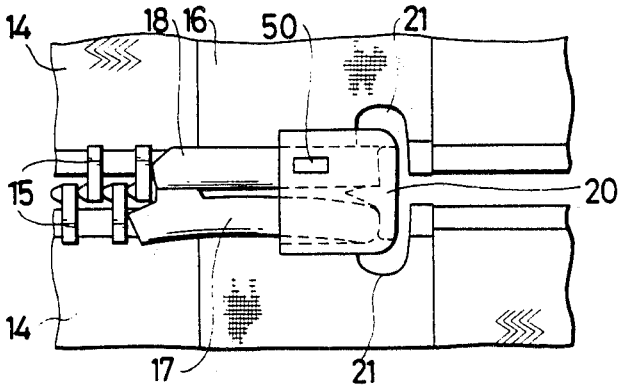
FIG. 8 is an enlarged fragmentary plan view the separable slide fastener chain with the box attached thereto.

An elongated separable slide fastener to be processed by the apparatus 11 is illustrated in FIG. 7A. The elongated separable slide fastener chain, generally indicated by the numeral 12 is composed of a pair of slide fastener stringers 13, 13 each comprising a stringer tape 14 and a row of coupling elements 15 mounted on and along an inner longitudinal edge of the stringer tape 14. The separable slide fastener chain 12 has a plurality of longitudinally spaced, film-reinforced element-free portions 16 extending transversely across the stringer tapes 13. An insertion pin 17 and a box pin 18 are attached to the inner confronting edges of the stringer tapes 14 at each of the element-free portions 16. A slider 19 is slidably mounted on the rows of coupling elements 15 to interconnect the stringer tapes 13, 13 and is positioned between two adjacent element-free portion 16. A box 20 is attached to the box pin 18 by the apparatus 11 with the insertion pin 17 received in the box 20. Each of the element-free portions 16 has a pair of confronting U-shaped recesses 21, 21 (FIG. 8) defined at the inner longitudinal edges of the stringer tapes 14, 14 adjacent to the insertion and box pins 17, 18. The recesses 21, 21 serve to facilitate insertion of the pins 17, 18 into the box 20. The elongate slide fastener chain 12 thus assembled is cut off across the element-free portions 16 along a transverse line 22 at the end of each of the box 20 which faces into the U-shaped recesses 21, 21, thereby producing an individual separable slide fastener 23 as shown in FIG. 7B.

The elongate slide fastener chain 12 will be longitudinally fed along a feed path through the apparatus 11 in such a direction that the end of each box 20 facing into the U-shaped recesses 21, 21 is the leading end and the box end into which the insertion and box pins 17, 18 are introduced is the trailing end.

As shown in FIG. 1, the apparatus 11 includes an elongate box holder 25 vertically disposed below a feed path of the separable slide fastener chain 12. The box holder 25 is slidably supported on a horizontal frame 26 and is connected to the piston rod of a first fluid actuator, such as an air cylinder 27 so as to reciprocate between an upper box attaching position (indicated by plantom lines) located in the feed path, and a lower box receiving position where boxes 20 are supplied one at a time to the box holder 25, as described below.

Figure 4:
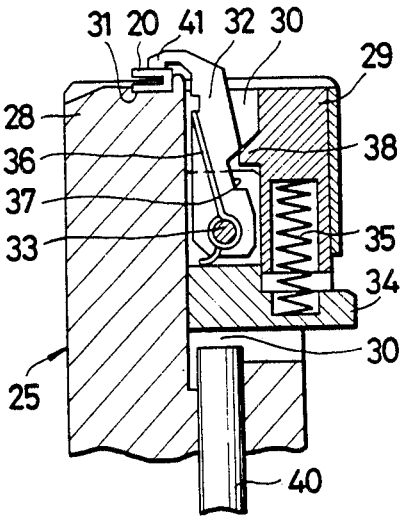
FIGS. 4 through 6 are enlarged vertical cross-sectional views illustrating successive steps of operation of the box holder.

The box holder 25 has an upper portion composed of a front portion 28 and a rear portion 29 separated by a recessed portion 30 defined therebetween (FIG. 4). The front portion 28 has in its top surface a recess 31 for receiving a box 20. The box holder 25 further includes a clamp finger 32 movably disposed in the recessed portion 30 for holding the box 20 stably in the recess 31 against displacement therefrom. The clamp finger 32 is pivoted at its lower end on a pin 33 secured to an upper portion of a slide block 34 slidably mounted in the recessed portion 30 from the bottom of the latter. The slide block 34 is urged downwardly by a compression coil spring 35 acting between the slide block 34 and the rear portion 29 of the box holder 25. A torsion spring 36 is supported on the pin 33 and acts between the slide block 34 and the clamp finger 32 to urge the latter clockwise (FIG. 1) toward the rear portion 29, thereby releasing the box 20.

The clamp finger 32 has in its rear surface a recessed cam follower portion 37 engageable with a cam 38 which projects from the rear portion 29 into the recessed portion 30 of the box holder 25, the cam 38 having an upper sloped cam surface. A second fluid actuator such as an air cylinder 39 is mounted on the lower end of the box holder 25 and has a piston rod 40 extending longitudinally in the box holder 25 and having an upper free end disposed in the recessed portion 30 below the slide block 34. The compression coil spring 35 is stronger than the torsion spring 36 so that the slide block 34 is normally held in a lowermost position shown in FIG. 6 where the cam 38 is out of engagement with the recessed cam follower portion 37 and urges the clamp finger 32 counterclockwise against the bias of the torsion spring 36 until the clamp finger 32 abuts against the front portion 28. The clamp finger 32 has a box-retaining free end portion 41 projectable into the box-receiving recessed portion 31 when the slide block 34 is in the lowermost position.

Figure 5:
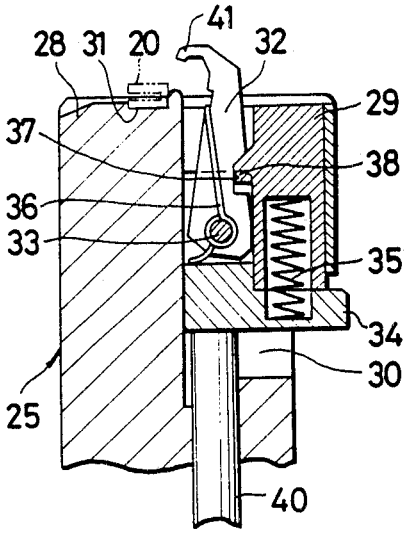
Figure 6:
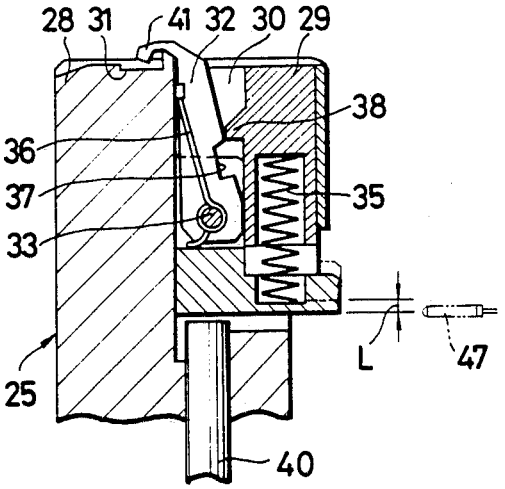

When the air cylinder 39 (FIG. 1) is actuated to extend its piston rod 40, the slide block 34 is moved upwardly from the lowermost position of FIG. 6 to an uppermost position of FIG. 5, against the bias of the compression coil spring 35. As the clamp finger 32 moves upwards along with the slide block 34, the recessed cam follower portion 37 engages the cam 38 whereupon the clamp finger 32 turns clockwise by the force of the torsion spring 36 to thereby open the box-receiving recess 31 of the box holder 25. When the piston rod 40 is retracted downwardly away from the slide block 34, the slide block 34 is lowered by the force of the compression coil spring 35, thereby lowering the clamp finger 32 supported thereon. As the clamp finger 32 moves downwards, the cam 38 is progressively brought out of engagement with the recessed cam follower portion 37 to thereby urge the clamp finger 32 to turn counterclockwise against the bias of the torsion spring 36. In case a box 20 is received in the recess 31 of the front portion 28, as shown in FIG. 4, the free end portion 41 of the clamp finger 32 forces the box 20 against the recessed portion 31 to thereby retain the box.

Figure 2:
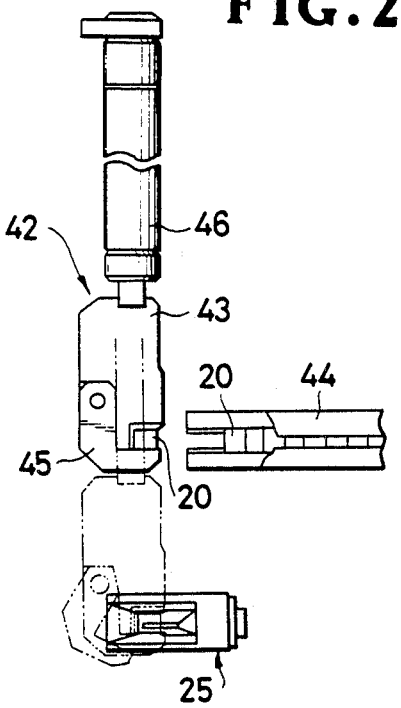
FIG. 2 is a schematic plan view of the box holding apparatus and a box feed mechanism combined with the box holding apparatus.

The boxes 20 are supplied one at a time to the box holder 25 by a box feed mechanism 42, as shown in FIG. 2. The box feed mechanism 42 comprises a gripper 43 for holding a box 20 supplied from a chute 44 and for placing the box 20 in the recess 31 of the box holder 25 while the latter is at rest in the box receiving position. The gripper 43 includes a grip finger 45 pivotably movable to hold the box 20 on the gripper 43 and to release the box 20 from the gripper 43, and an air cylinder 46 for reciprocating the gripper 43 between a loading position located adjacent to the discharge end of the chute 44, and an unloading position located immediately above the box-receiving position of the box holder 25. To supply the box 20 to the box holder 25, the air cylinder 27 is actuated to extend its piston rod for lowering the box holder 25 to its box-receiving position. Then the air cylinder 39 is actuated to extend the piston rod 40 whereupon the clamp finger 32 is angularly moved away from the front part 28 to open the recess 31 (FIG. 5). The gripper 43 with the box 20 retained thereon by the grip finger 45 is moved to the unloading position by the air cylinder 46. Then, the grip finger 45 is actuated to release the box 20 therefrom into the recess 31 of the box holder 25. The air cylinder 39 is actuated to lower the piston rod 40 whereupon the slide block 34 is lowered by the force of the spring 35, during which time the clamp jaw 32 is turned counterclockwise (FIG. 4) until the box retaining end portion 41 abuts the box 20. Upon abutment of the end portion 41 against the box 20, downward movement of the slide block 34 is terminated. Thus, the box 20 is retained stably on the box holder 25. As shown in FIG. 6, when the box 20 is misplaced or it is not present in the recess 41 for any reason, the slide block 42 is further moved downwardly by a distance L until the clamp finger 32 impinges against the front portion 28 of the box holder 25. Such further downward movement of the slide block 34, i.e. the absence of the box 20, is detected by a sensor 47 such as a photoelectric switch or a metal sensing proximity switch. Upon detection of the non-presence of the box 20, the sensor 47 sends an electric signal to a control unit (not shown) to automatically remedy such improper condition.

Figure 3:
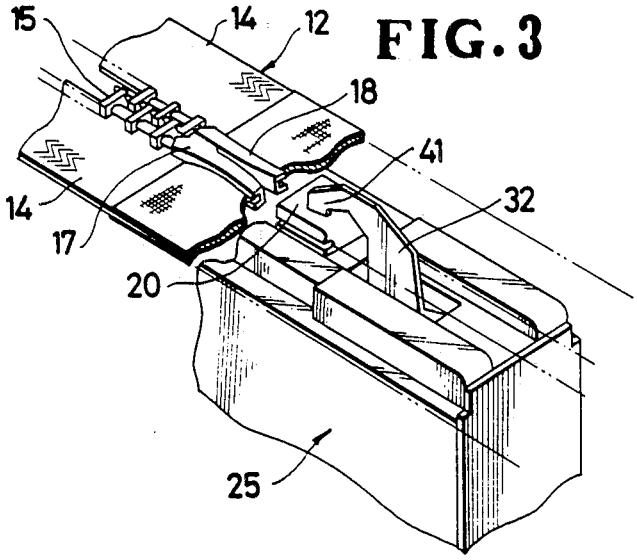
FIG. 3 is an enlarged fragmentary perspective view of a box holder of the box holding apparatus, the view showing a box retained on the box holder before attachment to a box pin on a separable slide fastener chain.
Figure 9:
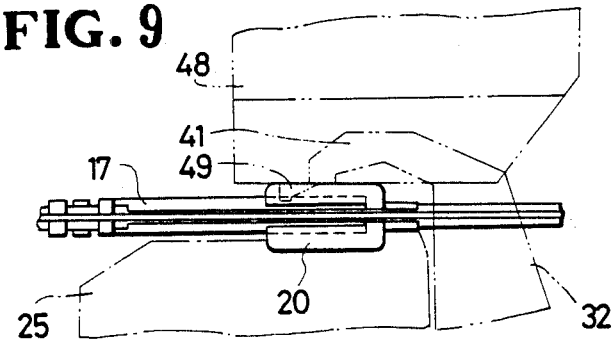
FIG. 9 is an enlarged front elevational view of the box just attached to the slide fastener chain by the box attachment apparatus.
Figure 10:
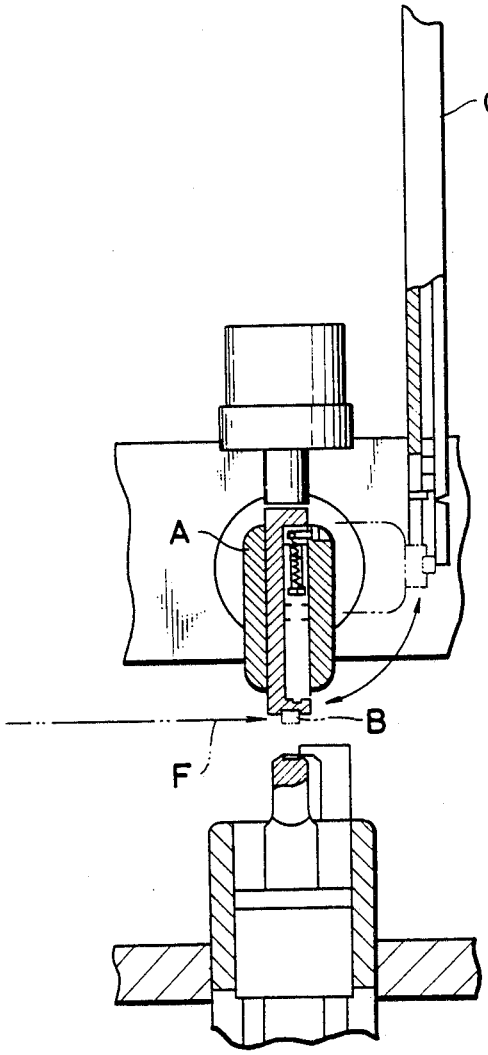
FIG. 10 (PRIOR ART)

With the box 20 properly retained on the box holder 25, the air cylinder 27 is actuated to move the box holder 25 upwardly to the box attaching position located in the feed path of the separable slide fastener chain 12 (FIG. 1). The box attachment apparatus 11 further includes a punch 48 vertically movably mounted on the frame 26 in alignment with the box holder 25 for attaching the box 20 to the box pin 18 (FIG. 3) on the slide fastener chain 12. As best shown in FIG. 9, the punch 48 has on its lower surface a central recess (not designated) for receiving the clamp finger 32, and a projection 49 for plastically deforming the material of the box 20 and the box pin 18 to clinch them together. The box 20 thus clinched has a rectangular recess 50 (FIG. 8) which forms a complementary locking jaw interlocking the box 20 and the box pin 18. Thereafter the slide fastener chain 12 is severed along the transverse line 22 into an individual separable slide fastener 23, as shown in FIGS. 7A and 7B. The box 20 and box pin 18 may be made of a synthetic resin, in which instance an ultrasonic horn is employed instead of the punch 48 so as to weld the box 20 and box pin 18. Alternatively, the box 20 may be snapped over the box pin 18 as the slide fastener chain 12 is threaded through the box 20 while the latter is retained in the feed path of the slide fastener chain. In this instance, the punch 48 can be omitted.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for holding a box in the process of attaching the box to a box pin on an end of a separable slide fastener fed along a feed path, comprising:

(a) a frame;

(b) a box holder vertically movably mounted on said frame and reciprocably movable between a box attaching position located in the feed path of the separable slide fastener chain and a box receiving position remote from said box attaching position, said box holder including a pair of spaced first and second portions defining therebetween a recessed portion, said first portion having a recess for receiving the box, said second portion having a cam facing said recessed portion;

(c) a slide block vertically movably disposed in said recessed portion;

(d) a clamp finger pivotably mounted on said slide block and having a free end portion engageable with the box to releasably retain the latter in said recess, and further having a portion engageable with said cam to cause said clamp finger to angularly move toward and away from said first portion, in response to vertical movement of said slide block, thereby bringing said free end portion into and out of engagement with the box;

(e) first means for reciprocating said box holder; and (f) second means for vertically moving said slide block.

2. An apparatus according to claim 1, said cam projecting into said recessed portion, said portion of said clamp finger including a recess receptive of said projecting cam.

3. An apparatus according to claim 1, said second means comprising a first spring acting between said second portion and said slider block to urge the latter in a first direction, and an actuator operative to urge said slide block in a second direction opposite to said first direction, against the bias of said first spring.

4. An apparatus according to claim 3, said first spring comprising a compression spring, said actuator comprising an air cylinder mounted on said box holder and having a piston rod engageable with said slide block.

5. An apparatus according to claim 4, including a second spring acting between said slide block and said clamp finger to urge the latter away from said first portion, said first spring being stronger than said second spring.

6. An apparatus according to claim 4, said piston rod being substantially received in said box holder and having a free end disposed in said recessed portion and engageable with said slide block.

* * * * *